US009713216B2

(12) United States Patent
Urry et al.

(10) Patent No.: US 9,713,216 B2
(45) Date of Patent: Jul. 18, 2017

(54) MULTI-SECTION PORTABLE ELECTRONIC TORCH

(71) Applicant: Zyntony, Inc., Sandy, UT (US)

(72) Inventors: Robin Urry, Draper, UT (US); Roger Johnsen, Holladay, UT (US); Russell Scott, West Jordan, UT (US); Jay Davis, Pleasant Grove, UT (US)

( * ) Notice: Subject to any disclaimer, the term of this patent is extended or adjusted under 35 U.S.C. 154(b) by 0 days.

(21) Appl. No.: 14/732,602

(22) Filed: Jun. 5, 2015

(65) Prior Publication Data

US 2016/0360585 A1 Dec. 8, 2016

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |
| ***H05B 37/02*** | (2006.01) |
| ***F21L 4/08*** | (2006.01) |
| ***F21L 4/02*** | (2006.01) |
| ***F21V 23/04*** | (2006.01) |
| ***F21V 33/00*** | (2006.01) |
| *F21Y 103/10* | (2016.01) |
| *F21Y 115/10* | (2016.01) |

(52) U.S. Cl.

CPC ..... *H05B 33/0845* (2013.01); *F21L 4/02* (2013.01); *F21L 4/08* (2013.01); *F21V 23/0414* (2013.01); *F21V 23/0435* (2013.01); *F21V 33/00* (2013.01); *H05B 37/0272* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS 6,979,100 B2 * 12/2005 Reiff ..... F21L 4/04 362/184

2012/0069165 A1 * 3/2012 Choi ..... H04N 1/00413 348/61

* cited by examiner

*Primary Examiner* — Anh Tran

(74) *Attorney, Agent, or Firm* — Atlas Intellectual Property Law; Travis Banta

(57) ABSTRACT

An electronic torch is disclosed which includes at least one light emitting diode disposed in each one of a plurality of sections of the electronic torch. In one embodiment, each one of the plurality of sections of the electronic torch is independently selectable to activate the at least one light emitting diode disposed in each one of the plurality of sections of the electronic torch. In another embodiment, a mobile device may be connected to the electronic torch and provide instructions to the torch via a wired or wireless connection.

9 Claims, 11 Drawing Sheets

MULTI-SECTION PORTABLE ELECTRONIC TORCH

BACKGROUND

1. Technical Field

This disclosure relates generally to a multi-section portable electric torch. More specifically, the multi-section portable electric torch provides light using a light emitting system designed to selectively emit light in various directions. The multi-section portable electric torch is controlled using a multi-function user button or wirelessly. The multi-section portable electric torch is rechargeable and may act as a power source to other devices.

2. Description of the Related Art

The word "torch" as used herein refers to the American usage of the term and should not be confused with other uses (e.g., British usage) of the term torch in connection with flashlights. Conventional torches are made of wooden sticks which are treated, on one end with a combustible material. The combustible material may be set on fire. While the combustible material burns, the torch emits light. Torches are generally held over the user's head, emitting light in a radius around the user. Unfortunately, as the combustible material on the torch is consumed by fire, conventional torches would drop burned combustible material which could result in burns to a torch user or could result in unintentionally starting a fire. With the advent of electricity, the use of torches fell out of favor because the likelihood of burns to a user or accidental fire was significantly reduced. Torches also consumed oxygen in restricted areas, such as subterranean caves. Flashlights and lanterns became a more favored method of portable light emanation.

Flashlights and lanterns, however, share light focusing problems. Flashlights, on one hand, provide a relatively narrowly focused beam of light, which results in fairly intense light in a single direction. Because of this narrow focus, the flashlight is able to illuminate objects, or portions of objects, at a distance. However, the flashlight provides very little ambient light to illuminate the user's surroundings.

On the other hand, lanterns generally have no light focusing ability. Lanterns provide light in a 360 degree circle which results in a significant amount of ambient light around the lantern which makes a lantern ideal for providing area light instead of directional light. However, a lantern provides very little light at a distance. Further, when held by a user, a lantern generally emits light back into the eyes of the user, reducing the user's night vision. Not only does emitting light into the eyes of a user make it more difficult for the user to see beyond the illumination radius of the lantern, but lanterns are also generally held by a handle on the top which places the lantern at eye level, maximizing the amount of light being emitted into the eyes of the user.

Thus, while flashlights and lanterns provide some utility in various situations, neither flashlights nor lanterns are useful in some situations. For example, flashlights cannot illuminate an entire campsite while a lantern cannot illuminate a significant length of a trail. Thus, in many cases, it has been advisable to use both a lantern and a flashlight to illuminate a dark area.

It is therefore one object of this disclosure to provide a multi-section portable electric torch. It is a further object of this disclosure to provide a four quadrant light emitting system designed to selectively emit light in one, two, three, or four quadrants. It is a further object of this disclosure to provide a multi-section portable electric torch with an elongated handle which allows the user to easily hold the multi-section portable electric torch overhead, while emitting light parallel to the line of sight of the user.

It is a further object of this disclosure to provide a multi-section portable electric torch that provides individual control of the pattern, brightness, sequencing, illumination duration, and selection of each individual quadrant in the four quadrant light emitting system. It is a further object to provide individual control of the multi-section portable electric torch via a multi-function user button or wirelessly with the use of a mobile device.

Finally, it is an object of this disclosure to provide a multi-section portable electric torch that is rechargeable through a variety of inputs and that may act as a power source for other devices.

SUMMARY

In one embodiment, an electronic torch is disclosed which includes at least one light emitting diode disposed in each one of a plurality of sections of the electronic torch. Each one of the plurality of sections of the electronic torch is independently selectable to activate the at least one light emitting diode disposed in each one of the plurality of sections of the electronic torch.

Further disclosed is an electronic torch system which includes an electronic torch, a mobile device, and a software application executed by a processor included in the mobile device. The mobile device is connected to the electronic torch and provides instructions to the electronic torch.

BRIEF DESCRIPTION OF THE DRAWINGS

The accompanying drawings illustrate several embodiments of the multi-section portable electric torch. The illustrated embodiments are exemplary and do not limit the scope of the disclosure.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
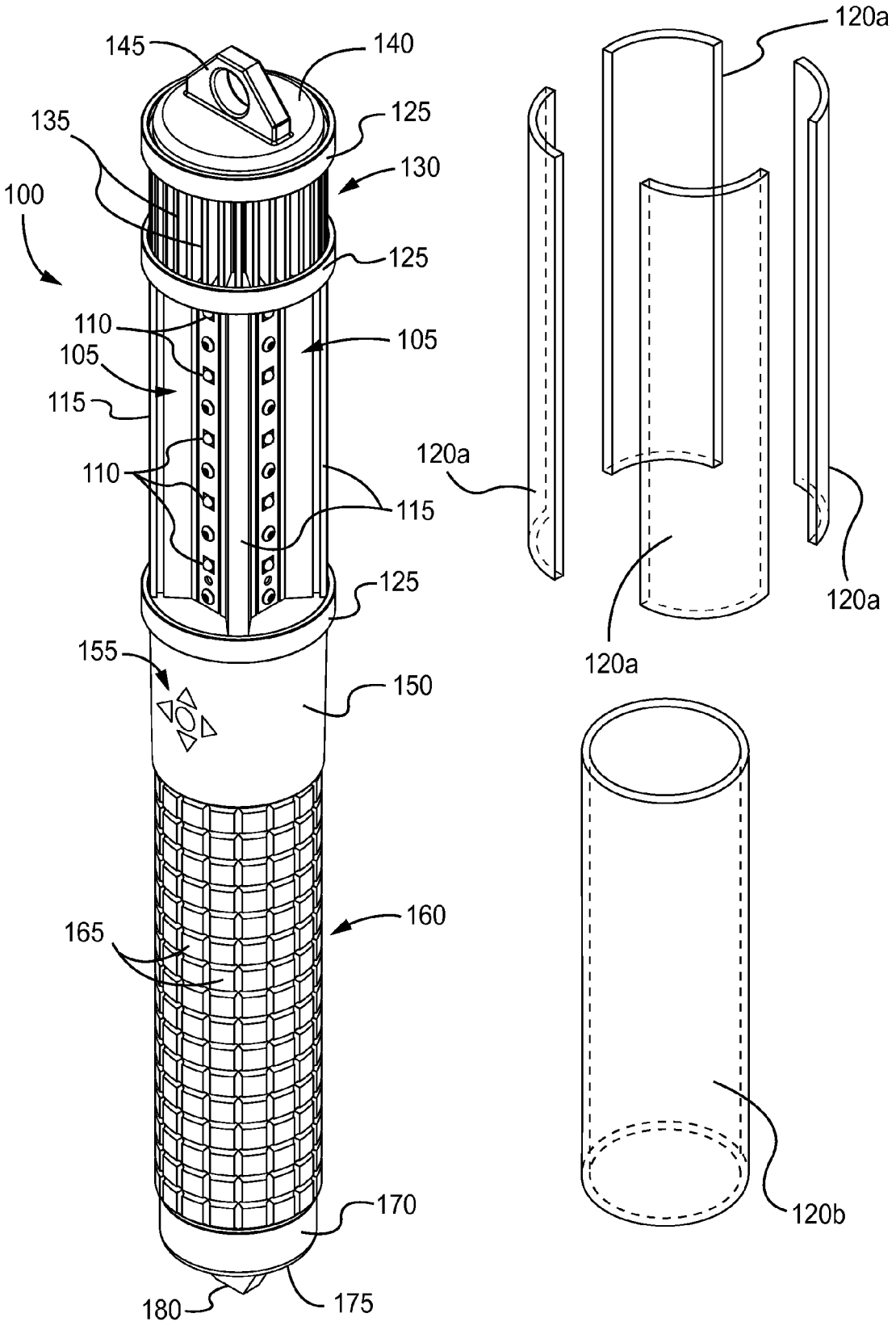
FIG. 1 illustrates one embodiment of a multi-section portable electric torch.

FIG. 1 illustrates one embodiment of a multi-section portable electric torch ("torch 100") disclosed herein. Torch 100 is divided into four quadrants by sections 105 of light emitting diodes ("LEDs") 110. One or a plurality of LEDs 110 are disposed along a vertical axis of torch 100. Sections 105 allow light to shine in 90 degree increments around the horizontal axis of torch 100 (although larger or smaller angles for more than 4 sections are possible). The combination of four 90 degree increments from each quadrant allows light to be emitted from torch 100 in a full 360 degree circle. Section walls 115 further allow light to be directed in one, two, three, or four quadrants independently of each other section, as will be discussed below. Section walls 115 are appendages extending radially along a vertical axis of torch 100. In one embodiment, section walls 115 are appendages that are formed as an integral part of a central heat sink core (not shown in FIG. 1) that helps keep LEDs 110 at a normal operating temperature. In another embodiment, section walls 115 may be mechanically (directly) and/or thermally (indirectly) connected to the central heat sink core without being an integral part of the central heat sink core, allowing section walls 115 to dissipate heat from the LEDs 110 into the central heat sink core. In one embodiment, section walls 115 and the central heat sink core are made of a metal, such as extruded aluminum bar stock. The central heat sink core may further include a post on both vertical ends with mechanical threads (male or female) that mate with other mechanical elements of torch 100, as will be further described below. It should be further noted that several elements besides LEDs 110 could generate substantial heat within torch 100. For example, circuitry, batteries, semiconductors, transistors, and other elements may generate heat that can be dissipated by various elements of torch 100.

Individual lenses 120*a* may be disposed over each one of individual sections 105 or, alternatively, one continuous lens 120*b* may be disposed over all four of sections 105. Individual lenses 120*a* or continuous lens 120*b* may be mechanically captured by section walls 115 using tabs, friction fittings, press fittings, or any other technology known in the art. In one embodiment, individual lenses 120*a* and continuous lens 120*b* are non-circular—square, triangular, rectangular, pentagonal, hexagonal, heptagonal, octagonal, or etc. One of individual lenses 120*a* may be hexagonal in one of sections 105 while another one of individual lenses 120*a* may be octagonal in another one of sections 105, for example. Individual lenses 120*a* and continuous lens 120*b* are typically constructed using plastic (such as polycarbonate plastic), one or more types of glass (such as safety glass), or crystal (such as sapphire). Individual lenses 120*a* and continuous lens 120*b* may or may not be clear, diffused, or filtered and may include physical properties and/or mechanical features that optimize the spectrum and/or directional pattern and intensity of light emitted from torch 100 for a specific purpose or use.

Torch 100, in one embodiment, further includes one or more escutcheons 125 that provide a mechanical and decorative visual transition to torch 100. Escutcheons 125 are typically metal discs, made out of extruded, machined, or cast aluminum for example, that provide rigid structure for attaching individual lenses 120*a* and continuous lens 120*b* to torch 100 while providing further mass and surface area to dissipate heat from LEDs 110. Thus, escutcheons 125 may be disposed within torch 100 such that escutcheons 125 and the central heat sink core are mechanically (directly) and/or thermally (indirectly) connected in a way that allows escutcheons 125 to dissipate heat created by LEDs 110.

Torch 100, in one embodiment, includes a heat sink 130. In this embodiment, heat sink 130 has a number of heat sink fins 135, which are radially disposed around heat sink 130. Heat sink 130 may contain any number of heat sink fins 135, however, 32 fins are generally optimal for heat dissipation in this configuration. Heat sink 130 may be mechanically (directly) and/or thermally (indirectly) connected to the central heat sink core to conduct heat away from LEDs 110 and dissipate that heat into ambient air. Heat sink 130 may also be constructed using a metal, such as extruded aluminum bar stock. Heat sink 130 may also include mechanical threads (male or female) for mating with the central heat sink core or threaded posts that interconnect the central heat sink core to heat sink 130.

The central heat sink core, escutcheons 125, and heat sink 130 each allow electrical connections, such as wires, to pass through them. In one embodiment, the central heat sink core, escutcheons 125, and radial heat sink 130 may be configured with hollow centers within which wires, for example, may be disposed. Alternatively, the central heat sink core, escutcheons 125, and heat sink 130 may include holes that allow wires, for example, to pass through. The central heat sink core, escutcheons 125, and heat sink 130 may include mechanical threads (male or female) that allow each of these elements to mate to each other or other elements of torch 100.

For example, in one embodiment, torch 100 includes a top accessory fitting 140 (shown here as a top cap) which may be threaded into any of the central heat sink core, escutcheons 125, or heat sink 130. For example, top accessory fitting 140 may include mechanical threads (male or female) for mating with mechanical threads (male or female) of another element of torch 100, such as heat sink 130. Alternatively, top accessory fitting 140 may be joined to other elements of torch 100 via threaded posts. Thus, in this embodiment, top accessory fitting 140 may be mechanically (directly) and/or thermally (indirectly) connected to the central heat sink core.

Top accessory fitting 140 is configured to both dissipate heat from LEDs 110 and allow attachment of some accessory via loop 145. Loop 145 typically includes a hole large enough in diameter to allow a standard rock climbing carabiner to pass through loop 145. Loop 145 may also be implemented as a hook, in another embodiment, instead of a full completed circular loop.

In another embodiment, top accessory fitting 140 may be removed in favor of another accessory with mechanical and/or electrical functionality. A non-limiting and non-exhaustive list of accessories that may replace top accessory fitting 140 includes, for example, a lamp shade, a compass, a flashlight, a spotlight, a beacon, and a fan, each of which may be threaded into torch 100 by the same mechanical threads (male or female) that may be used to attach top accessory fitting 140 to torch 100. Thus, torch 100 accepts multiple accessories, each of which may be individually installed in place of top accessory fitting 140.

Torch 100 includes, in one embodiment, a chassis barrel 150. Chassis barrel 150 is typically implemented using a metal, such as aluminum, which is machined or cast into a cylindrical housing, although any shape is conceivable (square, triangular, cylindrical with finger cut-outs, etc.). Chassis barrel 150 serves as a housing for electronic circuitry necessary to implement the functionality of torch 100 and includes internal mechanical mounts for rigidly fixing printed circuit boards within chassis barrel 150. Chassis barrel 150 further includes mechanical mounts for attaching function switches 155 to torch 100. Function switches 155 are discussed in further detail below. It is also conceivable that torch 100 could include an interface screen (not shown) in chassis barrel 150, or any other element of torch 100, including as an accessory, that provides a user with visual feedback on a particular mode the user wishes to implement.

In one embodiment, chassis barrel 150 may be mechanically (directly) and/or thermally (indirectly) connected to the central heat sink core and dissipate at least some heat generated by LEDs 110. Chassis barrel 150 provides substantial mass and surface area suitable for dissipating heat. Chassis barrel 150 further includes two sets of mechanical threads (male or female) for mating with mechanical threads (male or female) on the central heat sink core or a threaded post to connect chassis barrel 150 to the central heat sink core and to a battery tube 160.

Battery tube 160 is also implemented using a metal, such as aluminum, which is extruded or machined or cast into a cylindrical housing, although any shape is conceivable (square, triangular, cylindrical with finger cut-outs, etc.). In many embodiments, the shape of battery tube 160 will match the shape of chassis barrel 150, so long as appropriate batteries can be disposed within battery tube 160. Thus, battery tube 160 may be mechanically (directly) and/or thermally (indirectly) connected to the central heat sink core and dissipate at least some heat generated by LEDs 110. Battery tube 160 also provides substantial mass and surface area suitable for dissipating heat. Battery tube 160 may be finished with mechanical grip features 165 such as texturing to provide a user with an improved grip of torch 100 or more ergonomic access to function switches 155. Mechanical grip features 165 may also improve the aesthetics of torch 100.

Battery tube 160 may include electrical connections integrated into battery tube 160 or include electrical connections to a separate battery holder disposed inside battery tube 160. The electrical connections disposed within battery tube 160 route power and information signals between the electrical circuitry disposed within chassis barrel 150, other circuitry, and the batteries. Battery tube 160 further includes two sets of mechanical threads (male or female) for mating with mechanical threads (male or female) on chassis barrel 150 or a threaded post to connect chassis barrel 150 to the central heat sink core and to a battery tube end cap 170.

Battery tube end cap 170 is also implemented using a metal, such as aluminum, which is machined or cast into a cylindrical housing, although any shape is conceivable (square, triangular, cylindrical with finger cut-outs, etc.). In many embodiments, the shape of battery tube 160 will match the shape of chassis barrel 150 and battery tube end cap 170. Battery tube end cap 170 may be mechanically (directly) and/or thermally (indirectly) connected to the central heat sink core and dissipate at least some heat generated by LEDs 110. Battery tube end cap 170 further includes mechanical mounts for attaching a printed circuit board or boards that rigidly fix the printed circuit board or boards within battery tube end cap 170. The printed circuit boards disposed within battery tube end cap 170 include various connectors and a battery cutoff switch (not shown in this figure) which are externally accessible. One connector (e.g., a barrel jack) allows batteries within torch 100 to charge from an external power source while another connector (e.g., a Universal Serial Bus ("USB") jack) provides power to an external device, such as a tablet or a portable phone, from the batteries within torch 100. The battery cutoff switch allows the batteries to be completely disconnected from the electrical circuitry during periods of non-use which protects the batteries within torch 100 from unnecessarily discharging over time.

In one embodiment, the battery cutoff switch may control a MOSFET power switch (not shown) that disconnects a battery within torch 100 from other portions of the circuit preventing slow discharge of the batteries during periods of non-use. In one embodiment, the MOSFET power switch is powered such that when one of function switches 155 is pressed, the MOSFET power switch can restore battery power to torch 100. Battery tube end cap 170 may also include a connector for attaching one polarity of the batteries to torch 100.

Accessory bottom fitting 175 is an aluminum plug that mechanically threads onto external mechanical threads (male or female) on one end of battery tube end cap 170. In one embodiment, accessory bottom fitting 175 may include an integral wrist strap loop 180. Cordage, such as paracord, may be tied through or onto the wrist strap loop 180 to secure torch 100 to a user's hand or, alternatively, allow torch 100 to be hung in an inverted manner. Accessory bottom fitting 175 functions much like top accessory fitting 140 in that various accessories may be attached to torch 100 in place of accessory bottom fitting 175. These accessories may provide mechanical and/or electrical functionality. A non-limiting and non-exhaustive list of accessories that may replace accessory bottom fitting 175 includes a post of any height, a walking stick, a tripod, a zombie brain spike (discussed below), a downlight, a night light, and a fan. Accessories that may be installed in place of top accessory fitting 140 and accessory bottom fitting 175 may work together. For example, a motion detector accessory could be installed in place of top accessory fitting 140 and an alarm or a siren accessory could be inserted in place of accessory bottom fitting 175. In this example, if a motion detector accessory detected movement within, for example, a campsite sometime during a night, torch 100 is configured to activate another accessory, such as the alarm or siren accessory. Any two accessories can work in concert to further any particular goal.

In another embodiment, accessory bottom fitting 175 may be removed in favor of another accessory with mechanical and/or electrical functionality. One such example of an accessory that may replace accessory bottom fitting 175 and that includes a mechanical and electrical functionality is user interface device that includes a visual display screen or an interactive touch screen. For example, a user interface device that includes a visual display screen or an interactive touch screen could be threaded into torch 100 by the same kind of mechanical threads (male or female) that may be used to attach top accessory fitting 140 to torch 100 and electrically connected to torch 100 to receive visual data from torch 100. A user may then access, operate, or otherwise manipulate torch 100 using the user interface device accessory that includes a visual display screen or an interactive touch screen. Torch 100 accepts multiple accessories, each of which may be individually installed in place of accessory bottom fitting 175.

Each of the mechanically threaded connections within torch 100 discussed above may or may not include water-resistant seals to provide torch 100 with some degree of water resistance. Water resistant seals may include O-rings that are compressed between two threaded elements of torch 100. In other parts of torch 100, a gasket may be disposed between parts that are pressure-fitted to each other. In one embodiment, the light may be suitable for use under water or prevent water intrusion up to a specific depth, such as 100 feet. Underwater accessories may also be attached by the external mechanical threads on one end of battery tube end cap 170. For example, an underwater camera housing may be attached to torch 100 as an accessory and torch 100 may act as an underwater flash for a camera in the underwater camera housing.

Figure 2:
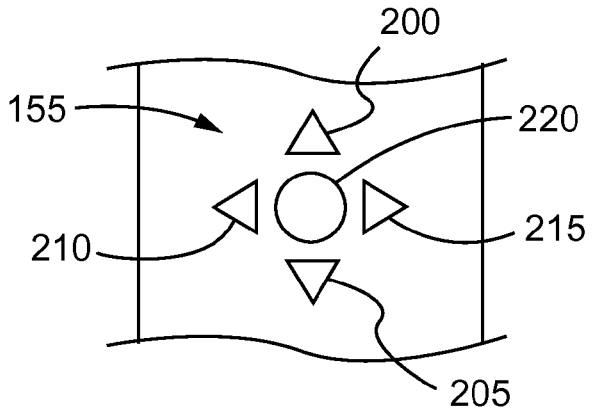
FIG. 2 illustrates an exemplary implementation of function switches on the multi-section portable electric torch.

FIG. 2 illustrates an exemplary implementation of function switches 155 in chassis barrel 150, shown in FIG. 1. Function switches 155 comprise a group of five switches, including up switch 200, down switch 205, left switch 210, right switch 215, and center switch 220. Center switch 220 acts primarily as an on/off switch for torch 100, shown in FIG. 1, but may also include an ability to select preset modes or functions for torch 100. Function switches 155 may be implemented as a five function joy stick style switch, a five button navigation switch, or with five discrete tactile switches. In other words, function switches 155 may be implemented with a five axis switch such that the function switches on torch 100 may be a single unit that is manipulated in five different axes to invoke different modes and settings of torch 100. In one embodiment, up switch 200 and down switch 205 control brightness levels of torch 100, shown in FIG. 1, in an intuitive manner (i.e., pressing up switch 200 makes torch 100 brighter and pressing down switch 205 makes torch 100 dimmer). In one embodiment, left switch 210 and right switch 215 allow a user to scroll through preset functions, such as illuminating various quadrants or sections 105 of torch 100 (shown in FIG. 1), emergency beacon modes, Morse Code flashing modes, and etc. One or more of function switches 155 may implement various different modes and functions with a push-and-hold operation of the function switches 155.

In a further embodiment, function switches 155 allow a user to scroll through torch modes and brightness settings. For example, if modes a, b, and c were contained within torch 100 and a user pressed right switch 215, the user could scroll through mode a, mode b, and mode c in a sequential order. However, if the user arrived at mode c by scrolling with right switch 215, and determined that mode b was more suitable, the user could re-access mode b by pressing left switch 210 which scrolls through the modes in the opposite direction from right switch 215, thereby arriving back at mode b. The user can therefore scroll through the various modes in a sequential order in two directions (in this example, mode a, mode b, and mode c or mode c, mode b, and mode a). Similarly, up switch 200 and down switch 205 may similarly scroll through various brightness settings in a similar manner.

Figure 3:
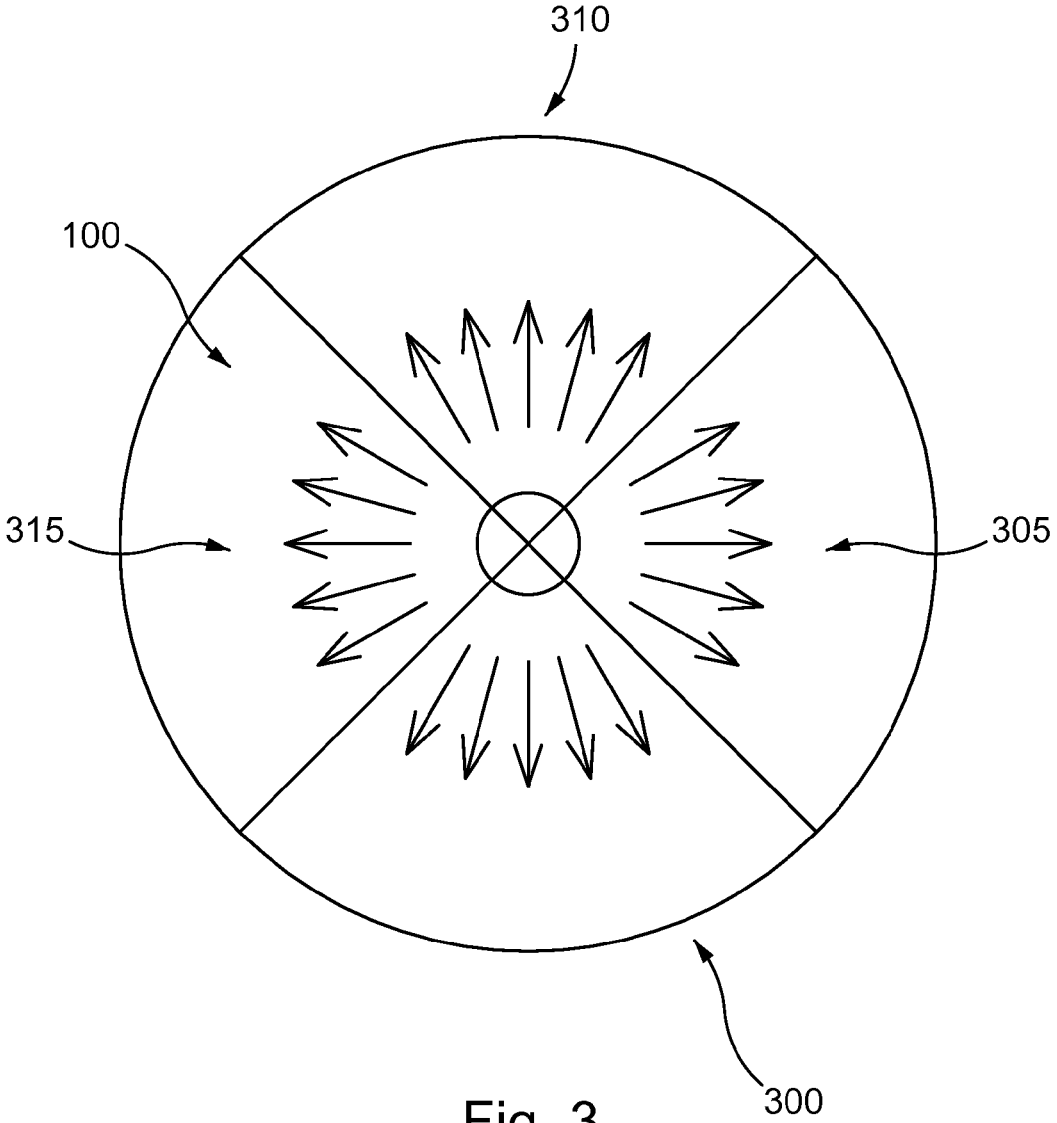
FIG. 3 illustrates a top down cross sectional view of the multi-section portable electric torch.

FIG. 3 illustrates a top down cross sectional view of torch 100, shown in FIG. 1. As discussed above, torch 100 is divided into 4 sections, identified here as quadrant 300, quadrant 305, quadrant 310, and quadrant 315. In this embodiment, quadrant 300 of torch 100 is oriented to face a user as quadrant 300 shares a vertical axis of torch 100 with function switches 155 (a vertex of the 90 degree angle created by sections 105 of torch 100 in FIG. 1 is directly in line with the center of function switches 155 along a vertical axis of torch 100). Thus, quadrant 300 would emit light toward a user of torch 100, quadrant 305 would emit light to the user's right, quadrant 310 would emit light away from the user, and quadrant 315 would emit light to the user's left.

As discussed above, a user of torch 100, may independently control LEDs 110 disposed in each of quadrants 300-315. Thus, a user may direct torch 100, via function switches 155 (shown in FIGS. 1 and 2), to emit light only in quadrant 310 or to emit light in quadrants 305, 310, and 315, for example. The user may direct torch 100, via function switches 155 (shown in FIGS. 1 and 2), to emit light in any one or combination of quadrants 300-315. In another embodiment, a user, via function switches 155, may direct torch 100 to emit light with different levels of brightness for each of quadrants 300-315 that are activated. In other words, one quadrant of torch 100 may emit light at one brightness level while another quadrant emits light at a different brightness level, or emits no light at all.

Figure 4A:
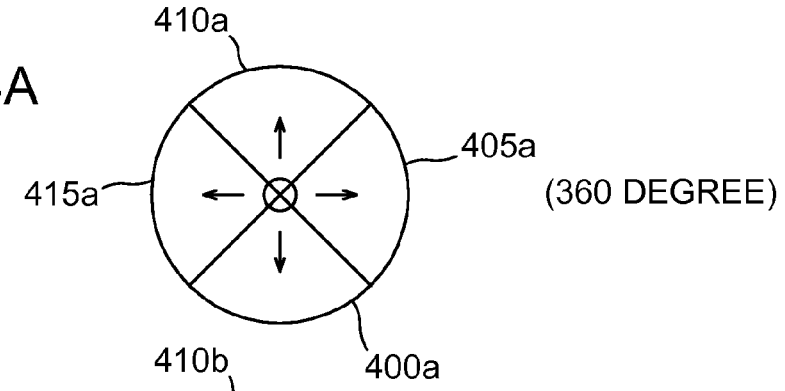
FIGS. 4A-4E illustrate a plurality of exemplary horizontal light dispersion patterns that may be implemented by the multi-section portable electric torch.

FIGS. 4A-4E illustrate a plurality of exemplary horizontal light dispersion patterns that may be implemented by torch 100 from the same top-down perspective as that shown in FIG. 3. FIG. 4A illustrates a 360 degree horizontal light dispersion pattern when torch 100 emits light from all 4 quadrants 400*a*, 405*a*, 410*a*, and 415*a*.

Figure 4B:
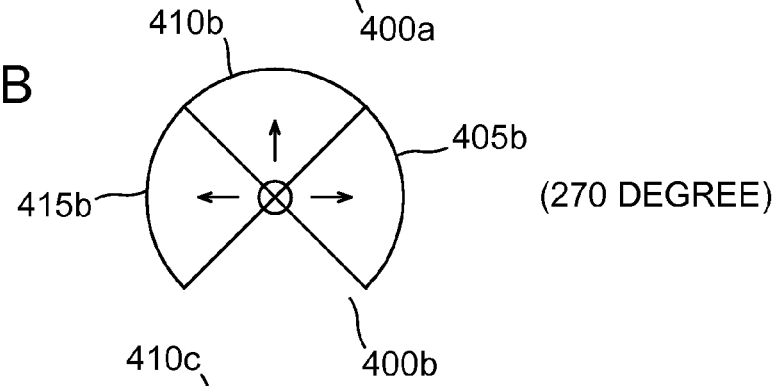

FIG. 4B illustrates one possible 270 degree horizontal light dispersion pattern when torch 100 emits light from 3 quadrants, 405*b*, 410*b*, and 415*b*, leaving quadrant 400*b* as a deactivated quadrant. Other 270 degree horizontal light dispersion patterns are possible using different combinations of activated and deactivated quadrants of torch 100. FIG. 4B merely illustrates one possible configuration of 270 degree horizontal light dispersion patterns. The illustrated 270 degree horizontal light dispersion pattern is advantageous when it is desirable to light a path or an area ahead of the user without emitting light directly into the eyes of the user.

Figure 4C:
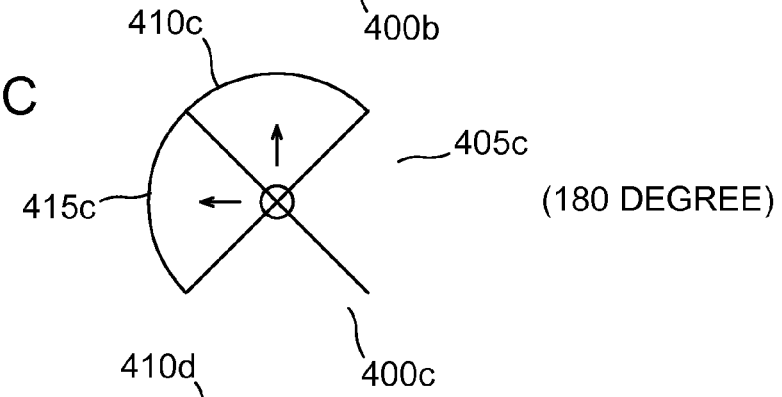

FIG. 4C illustrates one possible 180 degree horizontal light dispersion pattern when torch 100 emits light from two consecutive quadrants, 410*c* and 415*c* while leaving quadrants 400*c* and 405*c* as deactivated quadrants. Other 180 degree horizontal light dispersion patterns are possible using different combinations of activated and deactivated quadrants of torch 100. FIG. 4C merely illustrates one possible configuration of 180 degree horizontal light dispersion patterns when torch 100 emits light from two consecutive quadrants. These 180 degree horizontal light dispersion patterns are useful to illuminate boundaries (i.e., campsite boundary sides) where it would be wasteful and unnecessary to emit light into other areas.

Figure 4D:
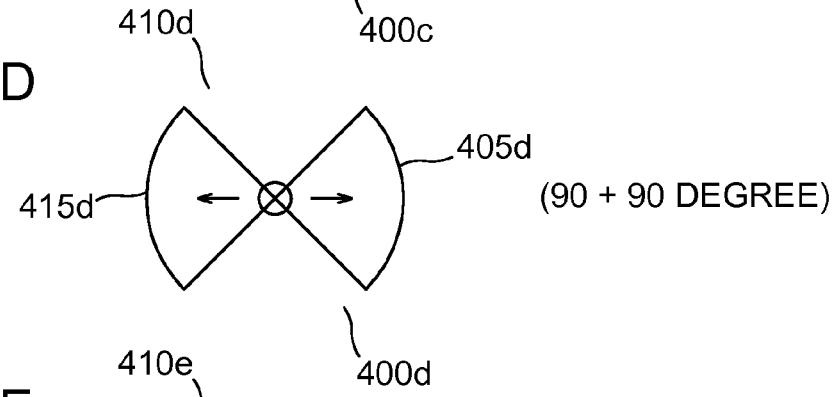

FIG. 4D illustrates one possible 180 degree horizontal light dispersion pattern when torch 100 emits light in two non-consecutive quadrants 405*d* and 415*d* while leaving quadrants 400*d* and 410*d* as deactivated quadrants. These 180 degree horizontal light dispersion patterns are also referred to as a "90+90" dispersion pattern. One other 90+90 horizontal light dispersion pattern is possible using a different combination of activated and deactivated quadrants of torch 100. FIG. 4D merely illustrates one of the two possible configurations of 90+90 degree horizontal light dispersion patterns when torch 100 emits light from two non-consecutive quadrants. These 90+90 horizontal light dispersion patterns are useful for illuminating a path or a campsite boundary line between corners.

Figure 4E:
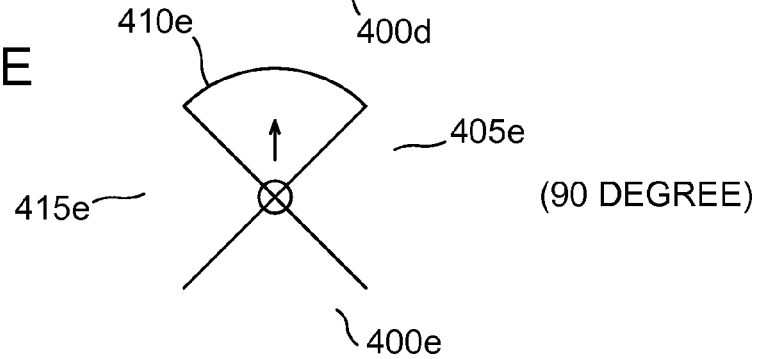

FIG. 4E illustrates one possible 90 degree horizontal light dispersion pattern when torch 100 emits light in one quadrant 410*e*, while leaving quadrants 400*e*, 405*e*, and 415*e* as deactivated quadrants. Other 90 degree horizontal light dispersion patterns are possible using different combinations of activated and deactivated quadrants of torch 100. FIG. 4E merely illustrates one possible configuration of a 90 degree horizontal light dispersion pattern when torch 100 emits light from a single quadrant. These 90 degree horizontal light dispersion patterns are useful for illuminating an area in front of a user or one corner of a campsite.

It is to be further noted that any one of the horizontal light dispersion patterns may include various sequencing, frequency, and duty cycle (i.e., on/off duration ratios) modes that control which quadrants are active at any particular time. For example, sequencing modes could include a strobe mode in which each of the quadrants emits light at a particular frequency (or number of emissions per second) and at a particular duty cycle, a beacon mode in which each of the quadrants repetitively emit very short bursts (typically at a very low duty cycle) of bright light, a spinning beacon in which each of the quadrants emit bursts of light in a sequence, and a battery level indication mode in which the speed of the light emissions indicates a battery level or in which the number of illuminated quadrants indicates a battery level. In one more complex embodiment, a user could control each one of LEDs 110, shown in FIG. 1, individually and the battery level indication may illuminate between 0 and 5 LEDs 110 on one quadrant to indicate a battery level of torch 100, shown in FIG. 1.

Figure 5:
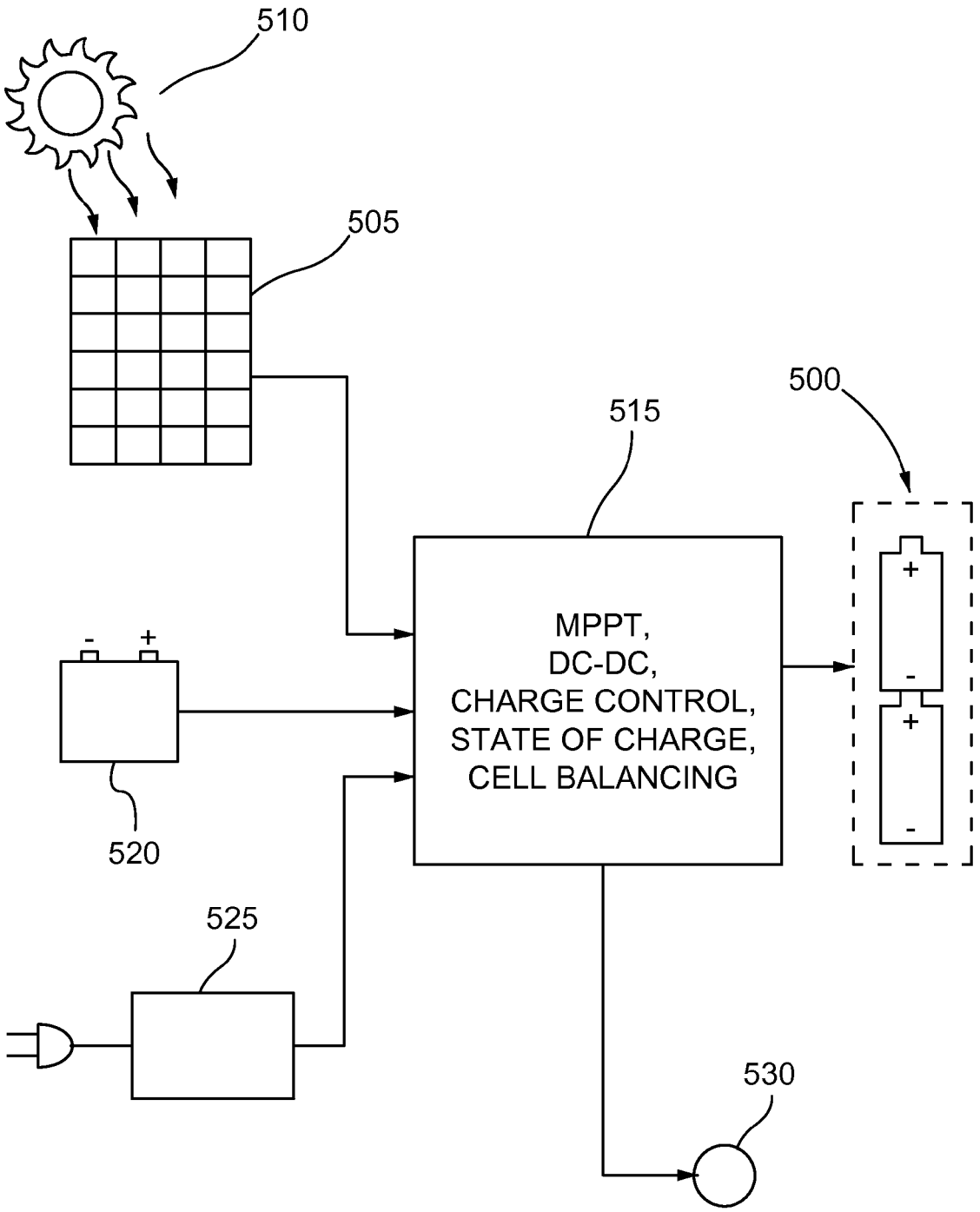
FIG. 5 illustrates a battery charging system for the multi-section portable electric torch.

FIG. 5 illustrates a battery charging system for torch 100, shown in FIG. 1. Battery 500 may be implemented as a single battery or a plurality of batteries that are connected in a series or parallel electrical configuration as necessary to supply an appropriate voltage and current for illuminating LEDs 110, shown in FIG. 1. Any suitable battery chemistry that provides adequate voltage and current may be implemented in battery 500. For example, NiCd (nickel-cadmium), NiMH (nickel-metal hydride), Li-ion (lithium ion), and LiFePO4 (lithium iron phosphate) are capable of providing adequate voltage and current for torch 100. During use of torch 100, shown in FIG. 1, electrical charge contained within battery 500 will be depleted. Thus, continued use of torch 100, shown in FIG. 1, requires that battery 500 be replaced or recharged. In an embodiment where battery 500 is to be replaced, torch 100, shown in FIG. 1, provides the user with access to battery tube 160, shown in FIG. 1 such that a user is able to remove and replace battery 500.

In an embodiment in which battery 500 is rechargeable, battery 500 may be charged by a solar panel 505 receiving solar radiation from the sun 510 via a battery management system 515. In one embodiment, battery management system 515 may include a maximum power point tracking function to continually monitor and modify the operating point of solar panel 505 in order to extract the maximum amount of power from solar panel 505. Battery management system 515 may also include a direct current to direct current ("DC to DC") converter to increase or decrease the amperage of direct current supplied to battery 500. In another embodiment, battery management system 515 controls a rate of charge of battery 500 in order to maximize battery lifespan and charge battery 500 as quickly as is prudent. In another embodiment, battery management system 515 may monitor a state of charging whether charging is ongoing, charging is complete, an error in charging has occurred, and etc. In another embodiment, battery management system 515 controls the charging of battery 500 in order to balance the charge of each cell within battery 500 such that battery 500 recharges uniformly to the maximum possible charge level. It should also be noted that solar panel 505 could be implemented as any type of renewable energy. In other words, wind turbines, water turbines, geothermal energy, and any other renewable energy may be utilized to charge battery 500.

Alternatively, battery management system 515 receives power directly from a vehicular battery 520 or via a vehicular battery 520 that is supplied with power via an alternator or generator in a vehicle. In this embodiment, torch 100, shown in FIG. 1, may be recharged by a 12 volt outlet in a vehicle such as a car, truck, boat, recreational vehicle, motor home, all-terrain vehicle, airplane, space craft, or any other vehicle. Battery management system 515 operates in a similar manner to that discussed above with the exception that the maximum power point tracking circuit is not necessary in view of vehicular battery 520 since vehicular battery 520 supplies 12 volts at a constant rate. Thus, battery management system 515 may still implement the DC to DC converter, a charge control circuit, a circuit to monitor the state of the charge, and a cell recharge balancing circuit in order to recharge battery 500.

Battery management system 515 may further receive power via an alternating current to direct current adapter ("AC-DC") adapter 525. In this embodiment, AC-DC adapter 525 supplies power at a constant rate at 12 volts. Thus, in this embodiment, battery management system 515 may still implement the DC to DC converter, a charge control circuit, a circuit to monitor the state of the charge, and a cell recharge balancing circuit in order to recharge battery 500. In one embodiment, power may be supplied to battery 500 via a power input jack (e.g., a barrel jack) disposed within torch 100, shown in FIG. 1.

Battery management system 515 may further be connected to gauge 530 that identifies an amount of power contained within battery 500. As battery 500 is recharged using solar panel 505, vehicular battery 520, or AC-DC adapter 525, a user may easily identify how much charge is currently stored within battery 500 using gauge 530.

Finally, it is further conceived that battery 500 may be removable, even if rechargeable, and recharged outside of torch 100, shown in FIG. 1. For example, an additional alternating power ("AC") charger may be provided which can recharge battery 500 when battery 500 is external to torch 100, shown in FIG. 1.

Figure 6:
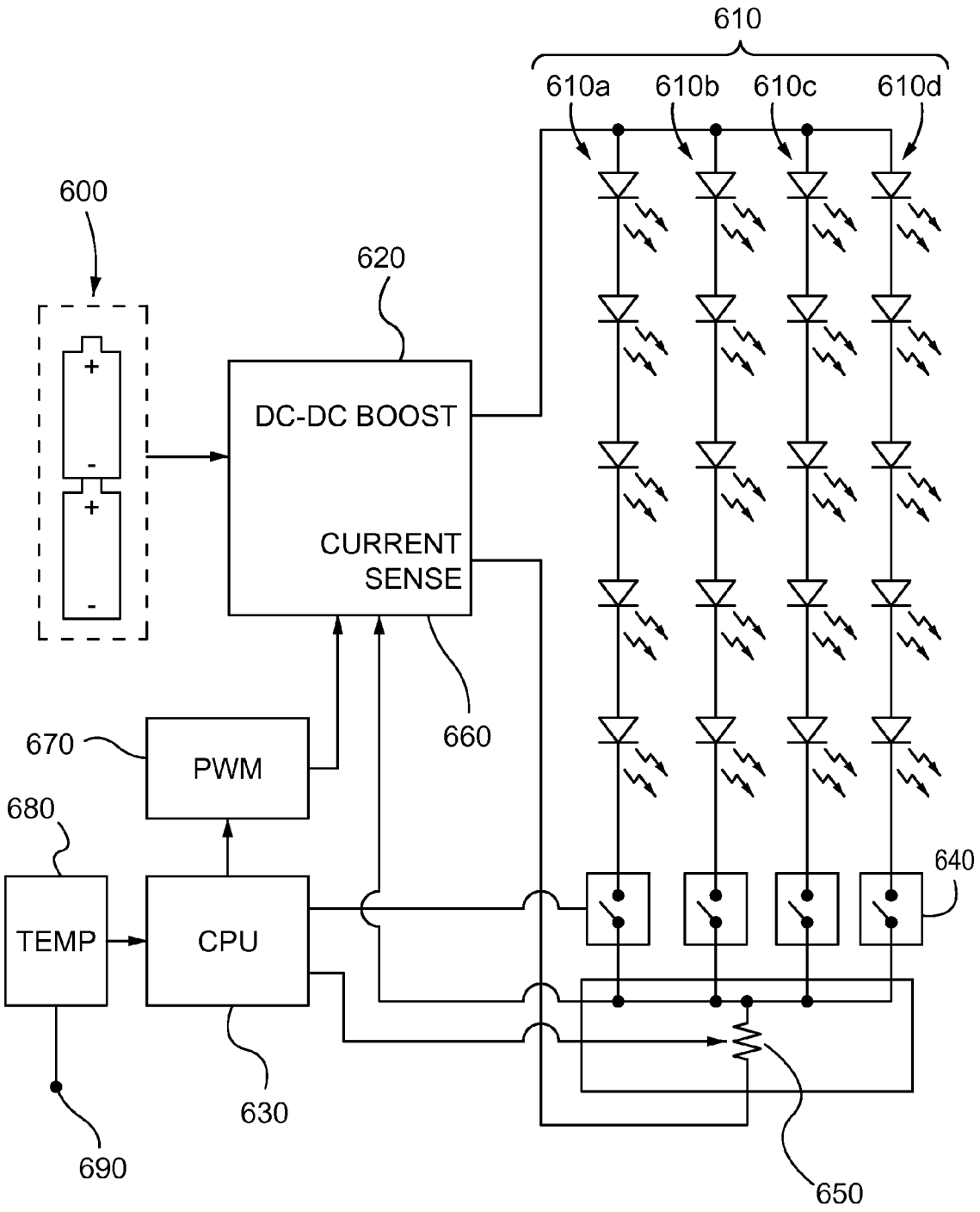
FIG. 6 illustrates a light drive circuit block diagram representing one embodiment of a light drive circuit used in the multi-section portable electric torch.

FIG. 6 illustrates an LED drive circuit block diagram representing an LED drive circuit used in torch 100, shown in FIG. 1. Battery 600, which is similar to battery 500 discussed above with respect to FIG. 5, supplies power to LED strings 610 via individual LED strings 610*a*-610*d* via a DC to DC boost controller 620. DC to DC boost controller 620 boosts the voltage of battery 600 from approximately 7.4 volts, in some embodiments, to a voltage necessary to drive one of individual LED strings 610*a*-610*d*. LED strings 610*a*-610*d*, in the example shown in FIG. 6, each contain 5 LEDs. Thus, each LED string 610*a*-610*d* would require approximately 15 volts of power. In the example of FIG. 6, DC to DC boost controller 620 provides a constant programmed current based on a desired current identified by CPU 630 according to user input (via function switches 155 shown in FIGS. 1 and 2). Each individual LED string 610*a*-610*d* is independently activated or deactivated by LED string switches 640. LED string switches 640 are controlled by CPU 630, according to user input.

Torch 100, shown in FIG. 1, can include a combination of one or more application programs and one or more hardware components. For example, application programs may include software modules, sequences of instructions, routines, data structures, display interfaces, and other types of structures that execute operation. Further, hardware components may include a combination of CPUs, such as CPU 630, buses, volatile and non-volatile memory devices, non-transitory computer readable memory device and media, data processors, control devices, transmitters, receivers, antennas, transceivers, input devices, output devices, network interface devices, and other types of components that are apparent to those skilled in the art. In one embodiment, CPU 630 may be accessed in order to download and install firmware updates for torch 100, shown in FIG. 1. These firmware updates may be provided to torch via a mobile device with a software application configured to update the firmware within CPU 630. Additionally, a particular light mode for each of LED strings 610*a*-610*d* may represent various stages of a firmware update process as the firmware update occurs.

In FIG. 6, the brightness level for each of individual LED strings 610*a*-610*d* is not independently controlled for each individual LED string 610*a*-610*d*. However, FIG. 6 shows one particular embodiment of an LED drive circuit. Other embodiments include individual brightness control for each of individual LED strings 610*a*-610*d*. In FIG. 6, individual LED strings 610*a*-610*d* are tied through common current setting resistors, represented in FIG. 6 as a single current setting resistor 650. While only a single resistor is shown in FIG. 6, current setting resistor 650 may include a plurality of switched parallel resistors which are each controlled by CPU 630. In one embodiment, CPU 630 may direct LED string switches 640 to select particular resistors to change the brightness level of individual LED strings 610*a*-610*d*.

In this embodiment, electric current flowing through individual LED strings 610*a*-610*d* is sensed and fed back to the LED current sense input 660 of DC to DC boost controller 620 which provides a loop control of the electric current supplied to individual LED strings 610*a*-610*d*. The LED drive circuit of FIG. 6 may further control the brightness of individual LED strings 610*a*-610*d* using a pulse width modulator 670 to manipulate, by pulse width modulation ("PWM"), DC to DC boost controller 620 under the control of CPU 630. While not shown in FIG. 6, a more complex LED drive circuit may include an independent current setting resistor (or resistors) 650 for each of individual LED strings 610*a*-610*d* that may be controlled by CPU 630.

The LED drive circuit shown in FIG. 6 may further include a temperature sensing chip 680 that measures an ambient temperature of the area around the temperature sensing chip 680. Some temperature sensing chips 680 may require an external temperature probe or thermocouple 690, coupled to a temperature sensing chip 680, to properly sense temperature in the area around the external temperature probe or thermocouple 690. Temperature sensing chip 680 may interface with CPU 630 and CPU 630 may control torch 100, shown in FIG. 1, based on the actual or inferred temperature of at least some components within torch 100, such as LEDs, semiconductors, or other temperature sensitive parts or circuitry. In one embodiment, temperature sensing chip 680 may be part of CPU 630 and external temperature probe or thermocouple 690 may be connected to a temperature sensing portion of CPU 630. In one example, when an ambient temperature of at least one of individual LED strings 610*a*-610*d* has reached a safe maximum level, CPU 630 may limit the electric current provided to at least one of individual LED strings 610*a*-610*d* by switching current setting resistor(s) 650 or by modifying the pulse width modulator 670 duty cycle such that DC to DC boost controller 620 reduces the current applied to the at least one of individual LED strings 610*a*-610*d*. Reducing the electric current applied to the at least one of individual LED strings 610*a*-610*d* reduces the brightness of the at least one of individual LED strings 610*a*-610*d* and the resulting temperature of the at least one of individual LED strings 610*a*-610*d*.

Figure 7:
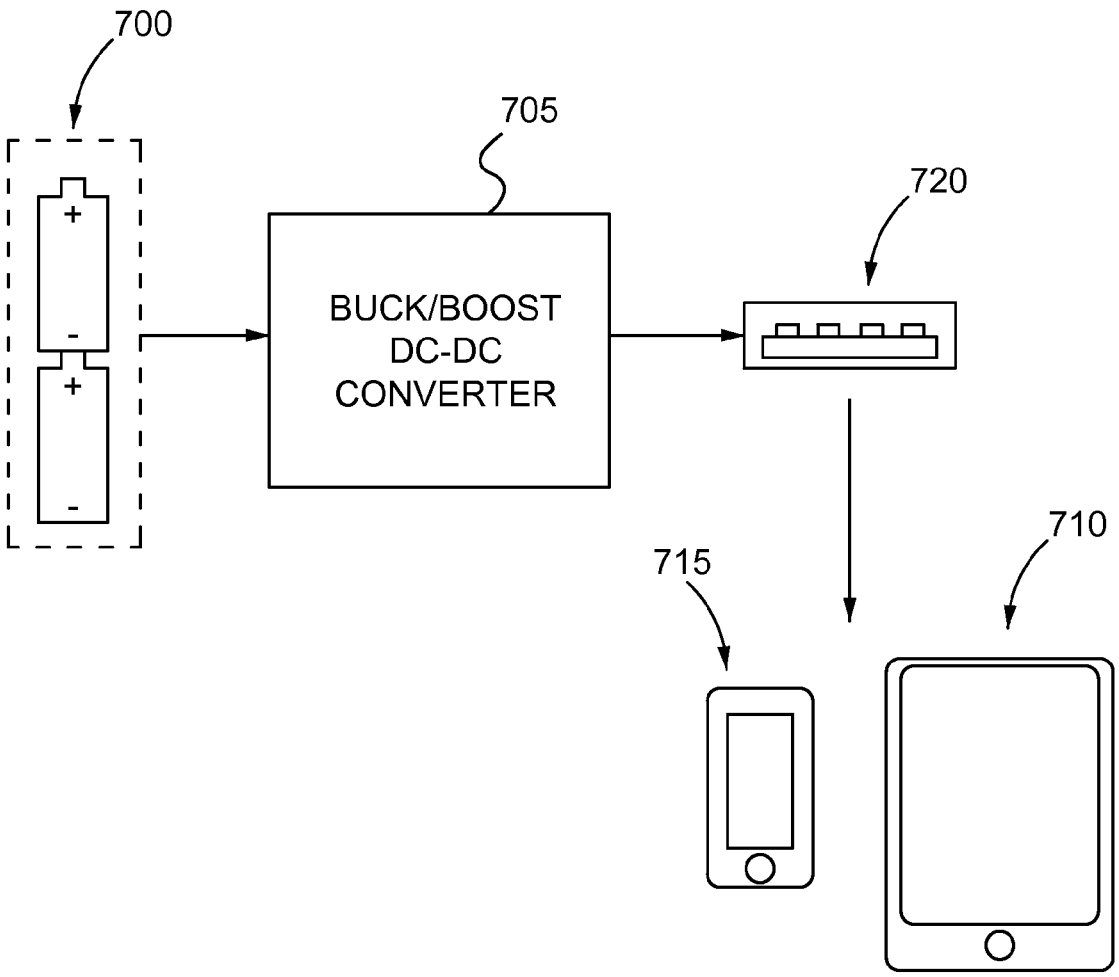
FIG. 7 illustrates a charging output circuit block diagram representing a one embodiment of a charging output circuit used in the multi-section portable electric torch.

FIG. 7 illustrates a charging output circuit block diagram representing a one embodiment of a charging output circuit used in the multi-section portable electric torch. The charging output circuit shown in FIG. 7 includes battery 700 that is similar to battery 500 shown in FIG. 5. Battery 700 provides a DC power source to buck/boost DC to DC converter 705. Buck/boost DC to DC converter 705 converts the DC electricity supplied by battery 700 into 5 volts at an electric current level sufficient to charge a mobile device, such as a tablet 710 or a smart phone 715. Tablet 710 or smart phone 715 connect to buck/boost DC to DC converter 705 by a USB output connector 720. In one embodiment, buck/boost DC to DC converter 705 supplies 5 volts of direct current electricity at 2-2.1 amps, resulting in approximately 10 watts of power supplied to a mobile device, such as tablet 710 or smart phone 715. 10 watts of power is more than adequate to power most mobile devices. In another embodiment, other devices may receive power from the charging output circuit shown in FIG. 7 so long as those devices' current requirements do not exceed the current output capability of the charging output circuit shown in FIG. 7.

Figure 8:
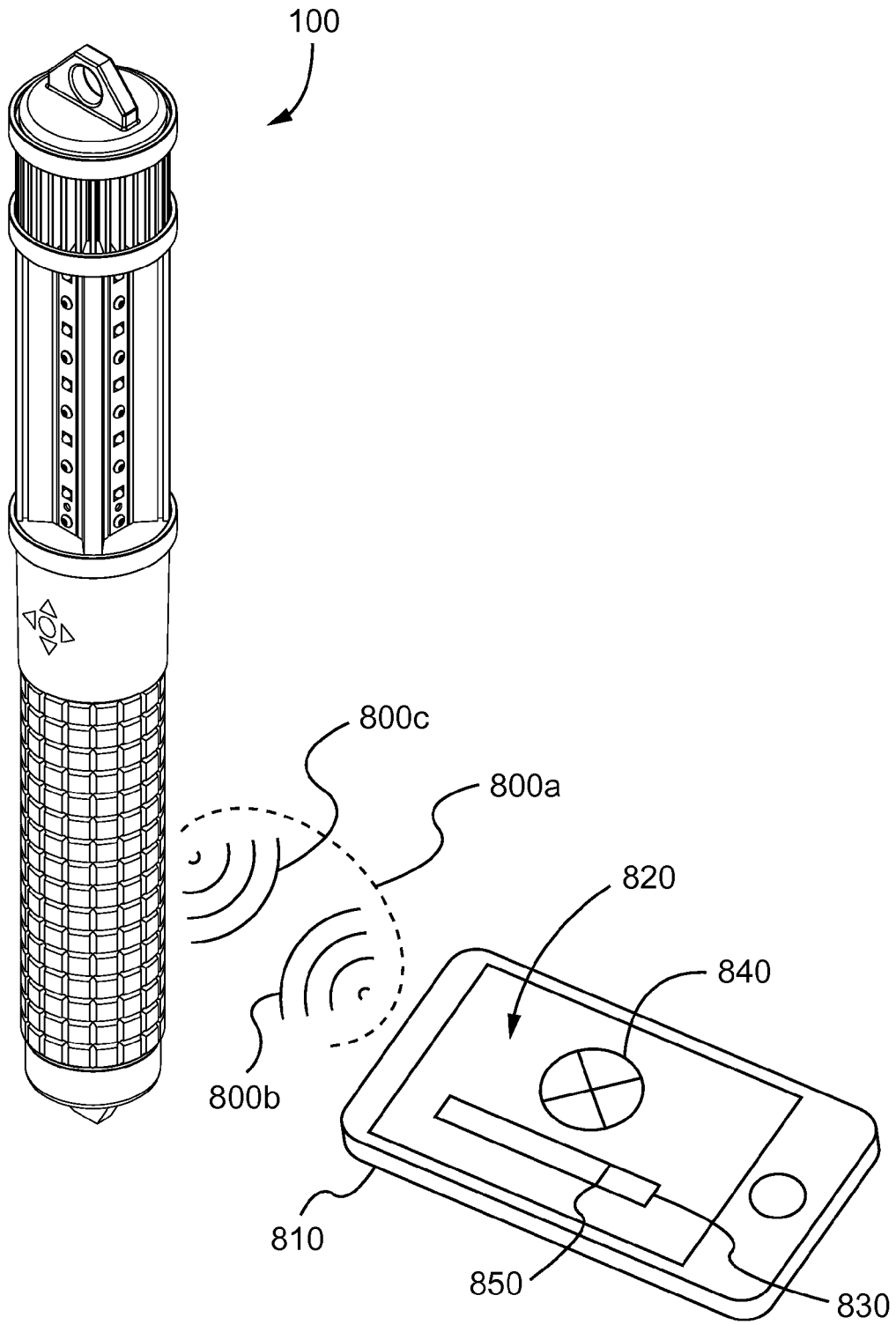
FIG. 8 illustrates a wireless communication connection between the multi-section portable electric torch and a mobile device.

FIG. 8 illustrates a wireless communication connection between torch 100, and a mobile device 810 using a Bluetooth wireless communication link 800*a*, although a wired communication connection is also possible. Wireless communication link 800*a* can be implemented using any known wireless connection protocols including Wi-Fi, ZigBee, Z-Wave, RF4CE, Ethernet, telephone line, cellular channels, or others that operate in accordance with protocols defined in IEEE (Institute of Electrical and Electronics Engineers) 802.11, 801.11a, 801.11b, 801.11e, 802.11g, 802.11h, 802.11i, 802.11n, 802.16, 802.16d, 802.16e, or 802.16m using any network type including a wide-area network ("WAN"), a local-area network ("LAN"), a 2G network, a 3G network, a 4G network, a Worldwide Interoperability for Microwave Access (WiMAX) network, a Long Term Evolution (LTE) network, Code-Division Multiple Access (CDMA) network, Wideband CDMA (WCDMA) network, any type of satellite or cellular network, or any other appropriate protocol to facilitate communication between torch 100 and mobile device 810. Wireless communication link 800*a* is constructed between a wireless communication transmitter/receiver 800*b* within mobile device 810 and a wireless communication transmitter/receiver 800*c* within torch 100.

Mobile device 810 may be implemented by any mobile electronic device, such as a smart phone, a tablet, a personal computer, a desk top computer, a music storage and playback device, a personal digital assistant, or any other device capable of implementing a software application 820. While it is noted that many devices are technically portable, other devices that are not conventionally thought of as portable could also interface with torch 100. Examples of these devices include desktop computers and other devices that are intended to be stationary, although technically mobile. Software application 820 is loaded into mobile device 810 and allows a user to control torch 100, send instructions to torch 100, or select one or more modes for torch 100 via manipulating user interface elements, such as brightness bar control element 830 and quadrant control element 840, in a user interface provided by software application 820 and displayed on a screen of mobile device 810. In one embodiment, wireless communication link 800*a* may be unidirectional such that torch 100 responds to instructions received from mobile device 810 without providing feedback to software application 820. In one example, software application 820 operating on mobile device 810 may include a brightness bar control element 830 that may be manipulated by a user to increase or decrease a brightness of an LED string within torch 100 via wireless communication link 800*a*. In another example, software application 820 operating on mobile device 810 may include a quadrant control element 840 that may be manipulated by a user to turn a particular quadrant of torch 100 on or off via wireless communication link 800*a*.

In most cases, however, it is expected that wireless communication link 800*a* is a bidirectional wireless communication link which provides feedback and/or control of software application 820 via wireless communication transmitters/receivers 800*b* and 800*c*. In one example, pressing an up switch 200, shown in FIG. 2, within function switches 155, shown in FIGS. 1 and 2, on torch 100 will not only increase the brightness of at least one LED string within torch 100 but will also send information to mobile device 810 that instructs software application 820 to move a brightness level indicator bar 850 within brightness bar control element 830 to represent that the brightness level of at least one LED string within torch 100 has been increased. Thus, wireless communication link 800*a* provides visual feedback of the current state of torch 100 to the user via software application 820 on mobile device 810.

In one embodiment, software application 820 may contain other modes, features, and functions. For example, software application 820 may include a power budgeter function that allows the user to instruct torch 100 to control power usage such that the power will last for a particular amount of time. In other words, if a user intends to go camping for seven days, the user can instruct software application 820 to download a power management plan to torch 100 that prevents torch 100 from using more than a particular amount of battery power during any particular day such that battery power for the torch is still available on the seventh day of camping for the user. In one embodiment, the power management plan could prevent battery power usage that is incompatible with the power management plan. In another embodiment, software application 820 could warn against usage that is incompatible with the power management plan. Software application 820 may further update the power management plan based on usage of torch 100 that is incompatible with the power management plan (i.e., recalculate an available amount of battery power usable by torch 100 during the rest of the seven day camping trip because of power usage that was inconsistent with the power management plan on one or more of the seven nights).

Another example of a function contained within software application 820 is a time delay function. For example, the time delay function of software application 820 allows a user to instruct torch 100 to turn off but only after a certain amount of time has passed from the instruction to turn off. For example, a camper may be ready for bed but may need some time to get settled in a sleeping bag. In this event, the camper could instruct torch 100 to turn off in eight minutes, giving the camper adequate light to get situated inside a sleeping bag in a tent. When eight minutes has elapsed, torch 100 may slowly dim as a warning that it is in the process of turning off. If for example, a user needs to get up during the night, the user can instruct torch 100 to turn back on, via the time delay function of software application 820, for a duration of time and then turn off again in four minutes, for example.

Figure 9:
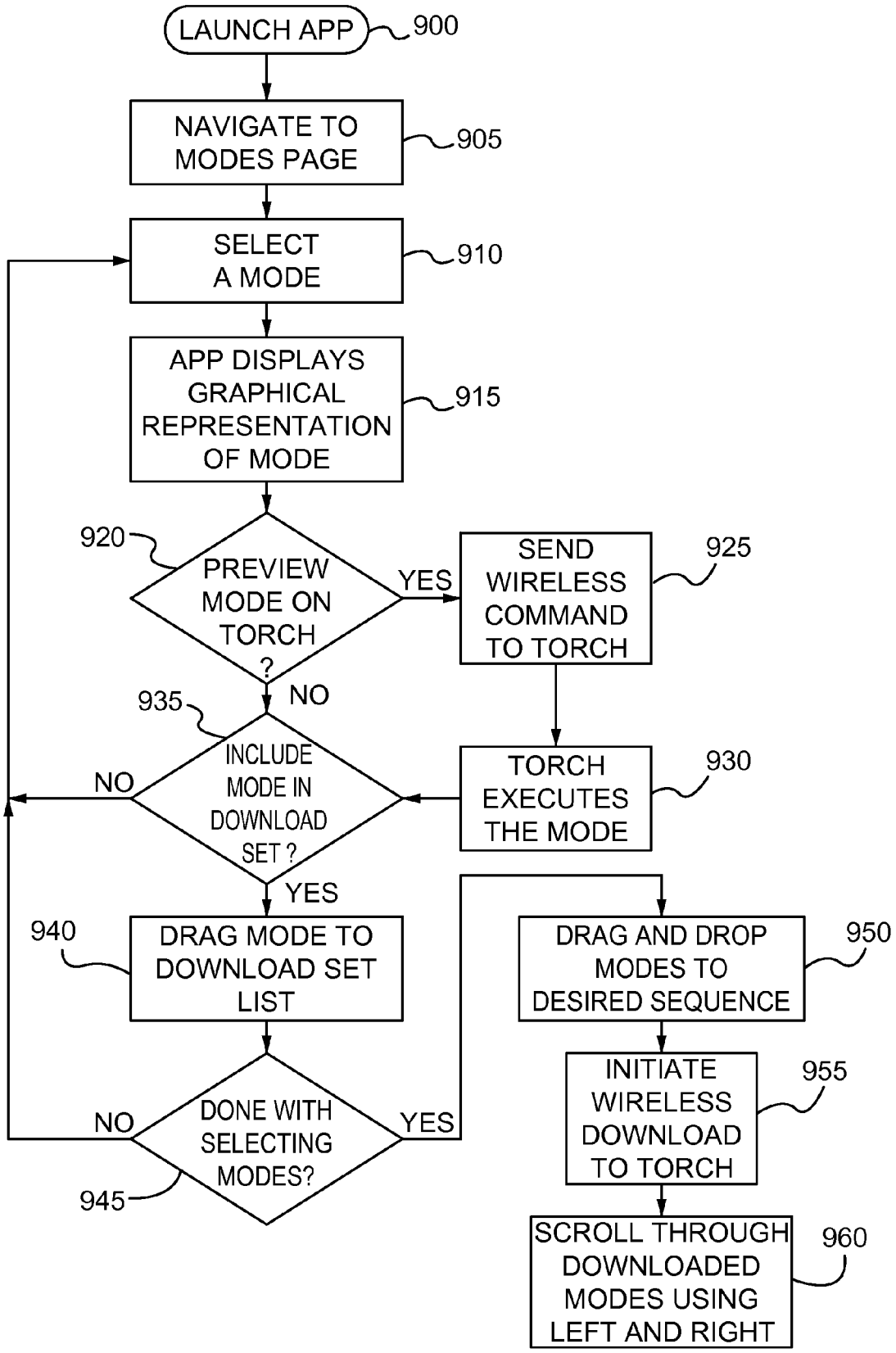
FIG. 9 illustrates a flowchart for selecting and downloading multi-section portable electric torch modes to the multi-section portable electric torch.

FIG. 9 illustrates a flowchart for selecting and downloading torch modes to torch 100, shown in FIG. 1. Several pre-programmed modes may be available for download to torch 100. For example, specialized light patterns may not be applicable to every user but may be desirable for some sub-set of users. Thus, torch 100 allows users to download preprogrammed modes that are helpful for a particular purpose. For example, a truck driver may desire a road-flare mode, an offshore mariner may desire an emergency beacon flare mode, a camper may desire a time delay shutoff mode and timer to allow the camper time to get into a sleeping bag without having to get out to turn torch 100 off. Many modes are conceivable based on a particular user's intended activities with torch 100.

Thus, FIG. 9 illustrates a block diagram for an exemplary process that allows a user to download preprogrammed modes for use in torch 100, shown in FIG. 1, and to select a sequential order of those modes (that may be scrolled through by left switch 210 and right switch 215, shown in FIG. 2 as part of function switches 155). The process begins by launching a software application, similar to software application 820 discussed above with respect to FIG. 8 on a mobile device similar to mobile device 810 discussed above with respect to FIG. 8, in step 900. A user may then navigate, via a user interface, to the preprogrammed modes page of the software application in step 905. At step 910 a user may select one of a plurality of listed available modes by selecting a desired mode name from the list. The software application may then display a graphical representation of the selected mode, including a mode animation for dynamic modes in step 915.

At step 920, the software application provides the user with an ability to preview a selected mode on torch 100. At step 920—yes, a wireless command is initiated and may be sent, at step 925, to torch 100 from the mobile device to direct torch 100 to execute the selected mode at step 930. If, the user does not preview the mode (step 920—No) or after the torch has executed the preview mode, the software application within the mobile device queries the user as to whether or not the user desires to include the particular mode in the download set at step 935. The download set is a set of data that identifies particular modes selected by the user that are to be downloaded to torch 100. If, at step 935—yes, the user elects to download a particular mode, the user may select that mode for download by, for example, dragging and dropping the mode into a download set list box in the software application user interface at step 940. If either the user decides not to include a mode for download (step 935—No) or the user is not done with selecting modes at step 945—No, the software application may return to a mode selection page and restart the process from step 910.

If the user has finished selecting modes at step 945 (*yes*), the user may further drag and drop the selected modes within the download set list box in the software application to orient the selected modes in a desired sequence at step 950. Once the selected modes are oriented in the desired sequence, the user can initiate, at step 955, a wireless download of modes to torch 100 by manipulating the user interface of the software application (i.e., pressing a download button). The process ends at step 960 in which the user can scroll through the downloaded modes on torch 100 using left switch 210 and right switch 215 of function switches 155 shown in FIG. 2.

The downloaded modes are immediately accessible to the user via torch 100. Favorite modes can, at that point, be quickly accessed by the user without excessive scrolling through the modes while modes that are less desirable to a user may be ignored. The process of FIG. 9 may further include downloading all available modes to torch 100 in a way that allows the user to easily access desired modes and to access all modes through a less accessible series of function button presses. In such a case, non-frequently used emergency modes may still be accessible, though not as easily accessible as, for example, a more commonly used mode. For example, an emergency beacon mode would likely be rarely used but that mode may still reside within torch 100 and be accessed from the torch without having to download the mode via the software application on the mobile device via the process of FIG. 9.

Figure 10:
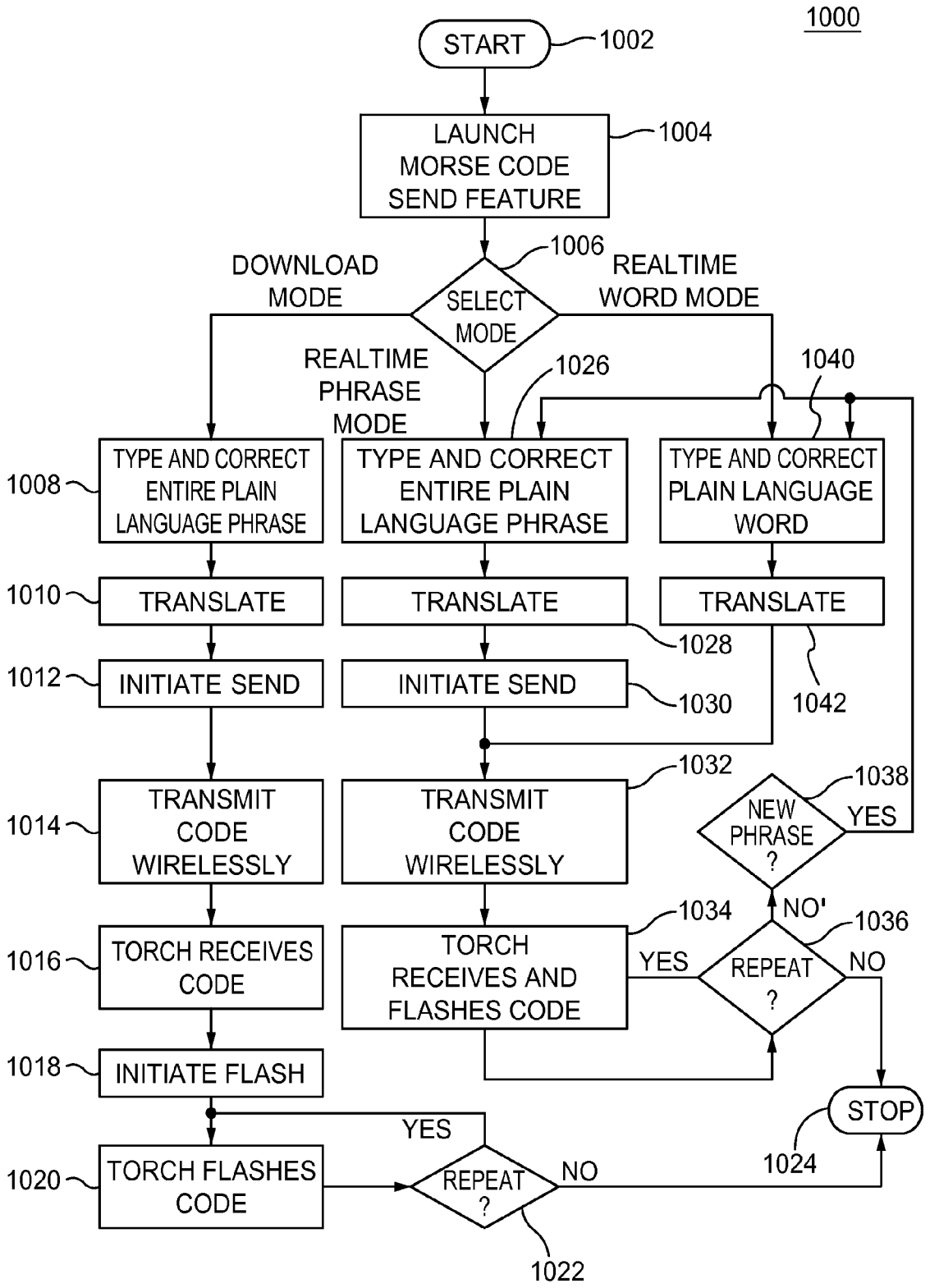
FIG. 10 illustrates a process for initiating a Morse Code transmission using the multi-section portable electric torch.

FIG. 10 illustrates a process for initiating a Morse Code transmission using torch 100, shown in FIG. 1. In one embodiment, torch 100 may emit light in a series of long and short bursts corresponding to Morse Code. Thus, a message may be transmitted by torch 100 by a series of long and short flashes which uniquely represent letters and numbers. A process 1000 to transmit a message using torch 100 begins at step 1002 which begins process 1000 on a software application executed by a mobile device (smart phone, a tablet, a personal computer, a music storage and playback device, a personal digital assistant, or any other portable device capable of executing a software application). The software application may be similar to the software application discussed above with respect to FIG. 8 and FIG. 9. Further, the software application may include directions for torch 100 for a mode that facilitates receiving a text input, translating the text input into Morse Code, and directing torch 100, shown in FIG. 1, to emit bursts of light corresponding to the Morse code encoding for the text input.

At step 1004, the software application is launched on a mobile device. The software application, at step 1006 requests a mode selection from the user. At step 1006, three modes are available for selection: a download mode, a realtime phrase mode, and a realtime word mode. If, at step 1006, the download mode is selected (1006—download mode), process 1000 transitions to step 1008 and allows a user to type an entire plain language phrase into the mobile device using a word processing function that allows a user to correct and edit the plain language phrase. Typing may be accomplished by a software or push button keyboard implemented by the mobile device. In download mode, the phrases or words entered by a user are automatically stored within a memory device in torch 100 as part of step 1008, step 1010, or step 1012 as a mode programmed to emit bursts of light representing the phrases or words in Morse Code. In this way, the user may easily access a mode for a stored phrase or word that is commonly used by the user by selecting a particular mode via function switches 155 or via an interface with an interactive screen connected to torch 100. For example, a user may commonly use torch 100 each day to signal that "dinner will be ready in 20 minutes" to another person who is fishing on a boat in a nearby lake. In download mode, the phrase "dinner will be ready in 20 minutes" may be stored within a memory device in the mobile device as a particular electronic torch mode. In this way, the user may navigate to that particular mode using functional switches 155 and an optionally include visual interface screen connected to torch 100 to select that particular mode each day as needed without typing the same phrases or words in each day. Thus, download mode provides the user the ability to both store and access one or more modes associated with commonly used phrases or words for transmitting a message via torch 100 without retyping a stored message.

At step 1010, when the user has entered the plain language phrase into the software application or selected the phrase as a commonly used phrase, the software application directs the processor in the mobile device to translate the plain language phrase into Morse Code. At step 1012, the mobile device initiates sending the translated plain language phrase to torch 100. At step 1014, the translated plain language phrase, now encoded in Morse Code, is transmitted to torch 100 wirelessly using any of the protocols discussed above with respect to FIG. 8. At step 1016, torch 100 receives the translated plain language phrase. At step 1018, a processor within torch 100 initiates a series of light emissions corresponding to the Morse Code representation of the translated plain language phrase. When torch 100 has initiated the series of light emissions, torch 100 emits, at step 1020, a series of light emissions corresponding to the Morse Code representation of the translated plain language phrase. The software application being executed on the mobile device may allow the user to repeat the series of light emissions at step 1022. If the series of light emissions is to be repeated (1022—yes), process 1000 returns to step 1020 and re-emits the series of light emissions corresponding to the Morse Code representation of the translated plain language phrase. At the point the user determines that the light emissions should not be repeated (1022—no), the process stops at step 1024.

Returning to step 1006, if a user selects the realtime phrase mode (1006—realtime phrase mode), the user may type an entire plain language phrase into the mobile device using a word processing function that allows a user to correct and edit the plain language phrase. Typing may be accomplished by a software or push button keyboard implemented by the mobile device. At step 1026 the mobile device receives user input representing a plain language phrase via a word processing function that allows a user to type and edit the plain language phrase. At step 1028, when the user has entered the plain language phrase into the software application, the software application directs the processor in the mobile device to translate the plain language phrase into Morse Code. At step 1030, the mobile device initiates sending the translated plain language phrase to torch 100. At step 1032, the translated plain language phrase, now encoded in Morse Code, is transmitted to torch 100 wirelessly to torch 100 using any of the protocols discussed above with respect to FIG. 8. At step 1034, torch 100 receives the translated plain language phrase and emits a series of light emissions corresponding to the Morse Code representation of the translated plain language phrase. If the series of light emissions is to be repeated, (1036—yes), process 1000 returns to step 1034 and re-emits the series of light emissions corresponding to the Morse Code representation of the translated plain language phrase. At the point, the user determines that the light emissions should not be repeated, (1036—No), the process can either end at step 1024 or (1036—No') allow a user to enter a new plain language phrase to be input at step 1038. If a user desires to input a new phrase (1038—yes), the user can restart process 1000 at step 1026 or enter realtime word mode at step 1040, which is discussed below.

Returning to step 1006, if a user selects realtime word mode (1006—realtime word mode), the user may type a word into the mobile device using a word processing function that allows a user to correct and edit the word. Typing may be accomplished by a software or push button keyboard implemented by the mobile device. In realtime word mode, the space bar on the software or push button keyboard acts as a "send" button. In other words, once the word is typed at step 1040 and the space bar button on the software or push button keyboard is activated, process 1000 translates the word into Morse Code at step 1042 and transmits the translated word wirelessly to torch 100 using any of the protocols discussed above with respect to FIG. 8 at step 1032. Torch 100 receives the translated word and emits a series of light emissions corresponding to the Morse Code representation of the translated word at step 1034. At the point, the user determines that the light emissions should not be repeated, (1036—No), the process can either end at step 1024 or (1036—No') allow a user to enter a new word or phrase to be input at step 1038. If a user desires to input a new word or phrase (1038—yes), the user can restart process 1000 at step 1026 or re-enter realtime word mode at step 1040.

Figure 11:
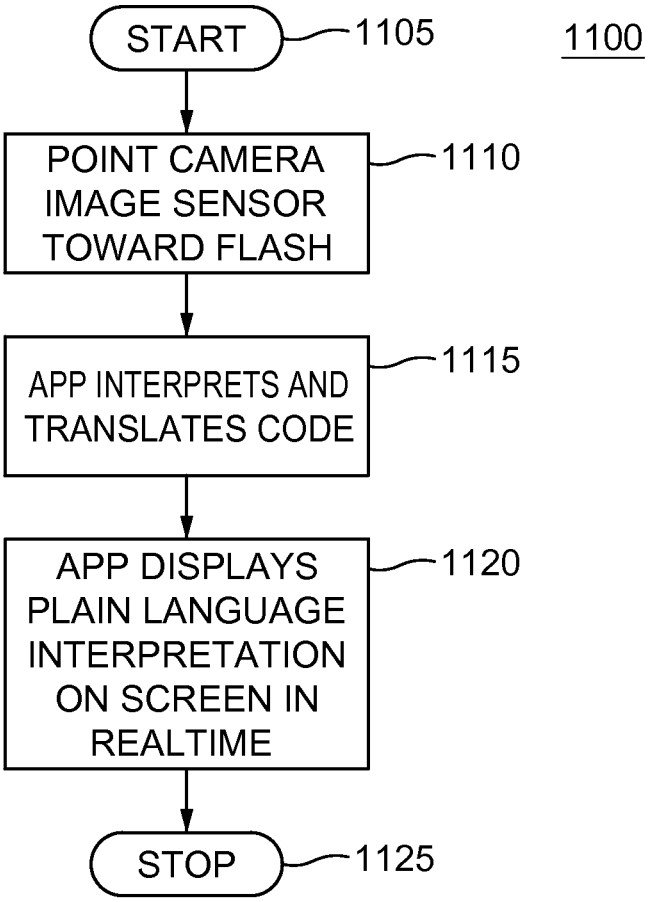
FIG. 11 illustrates a process for translating a Morse Code transmission into plain language.

FIG. 11 illustrates a process 1100 for translating a Morse Code transmission into plain language. As discussed above with respect to FIG. 10, torch 100 can emit light in a series of short and long bursts that represent letters and numbers using Morse Code. However, many people do not readily understand Morse Code and cannot easily interpret Morse Code. Process 1100 may be included as a function in a software application executed by a mobile device that receives, translates, and displays a received string of Morse Code light emissions in plain language.

Process 1100 begins at step 1105. At step 1110, a user points an optical sensor within a mobile device (smart phone, a tablet, a personal computer, a music storage and playback device, a personal digital assistant, or any other portable electronic device that includes an optical sensor) at a series of light emissions and encoded using Morse Code. In one embodiment, torch 100, shown in FIG. 1, may include an optical sensor for receiving light emissions from a light source, such as another electronic torch, independent of another mobile device. In another embodiment, torch 100 may be emitting the series of light emissions. However, it is conceivable that the optical sensor in the mobile device can be used with light emissions from any source that are encoded using Morse Code. The optical sensor within a mobile device may be a camera, for example. Other optical sensors are known in the art and may be implemented in a mobile device to suit any desired implementation. As the optical sensor within the mobile device receives the series of light emissions from torch 100, a software application being executed on the mobile device interprets and translates the light emissions from Morse Code into plain language at step 1115. At step 1120, the software application being executed on the mobile device displays a plain language interpretation on a screen of the mobile device in realtime as it receives the light emissions from torch 100. Once the software application has displayed the plain language interpretation of the Morse Code transmission, process 1100 stops at step 1125.

In this way, users who are not familiar with Morse Code may still benefit from the use of Morse Code by a mobile device used in concert with torch 100. This is a particularly advantageous feature to campers, fishermen, wilderness adventurers, mountain climbers, rock climbers, and other outdoorspeople who may be out of range for cellular phone service in that they may still communicate with others in their party from a significant distance even though those outdoorspeople may not be familiar enough with Morse Code to use it practically.

Figure 12:
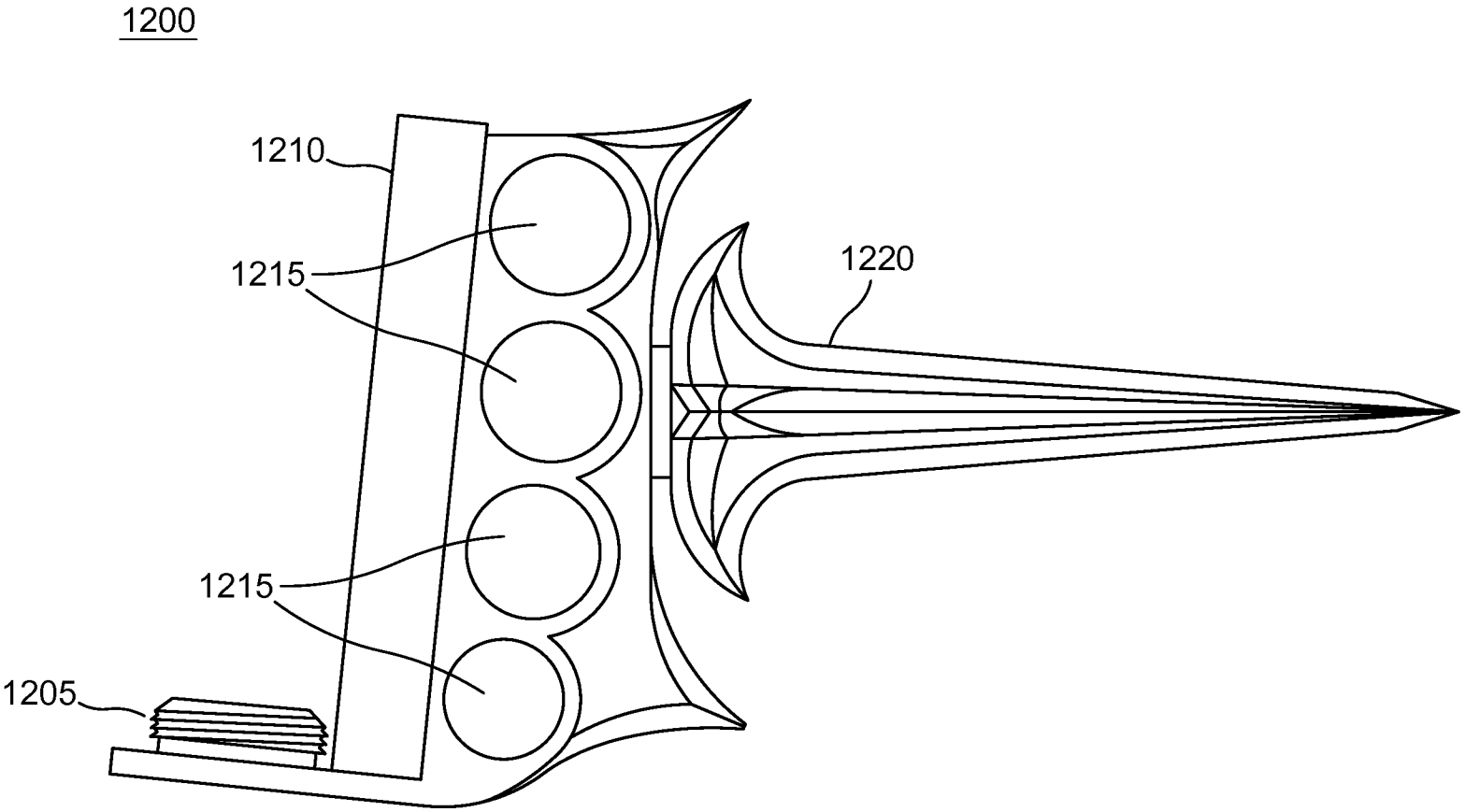
FIG. 12 illustrates an exemplary accessory associated with the multi-section portable electric torch.

FIG. 12 illustrates an exemplary accessory associated with torch 100. Zombie brain spike 1200 may be threaded into torch 100, shown in FIG. 1 as an accessory, as discussed above with respect to FIG. 1, elements 140 and 175, by mechanical threads 1205 that mate with the mechanical threads receiving accessories in torch 100. While zombie brain spike 1200 would be effective in dispatching conventionally known zombies, if they existed, the use of zombie brain spike 1200 is not limited to dispatching zombies. Zombie brain spike 1200 includes a lightweight aluminum handle 1210 that facilitates quick motion while decreasing user fatigue. Handle 1210 may be angled between 0 degrees and 5 degrees relative to torch 100 for ergonomics and to reduce fatigue and the potential for wrist injury to the user with repeated use. Handle 1210 may further include finger holes 1215 that function as brass knuckles to prevent strain on the user's knuckles from, for example, repeatedly dispatching zombies using zombie brain spike 1200. Finger holes 1215 may include extended guard tips that re-center off centered strikes with zombie brain spike 1200. In one embodiment, zombie brain spike 1200 may include a blade 1220. Blade 1220 is removable from handle 1210 for easy sharpening. As shown in FIG. 12, blade 1220 is a double edged blade made of tempered high carbon steel with a strong blade draft to facilitate easy blade removal from, for example, a dispatched zombie. Other blades and piercing instruments may be used in place of blade 1220. For example, blade 1220 may be removed in favor of a pointed spike, a longer blade, a can opener, a magnifying glass, a toothpick, tweezers, a regular or Philips screwdriver, an awl, scissors, a saw, silverware (fork, spoon, spork, and etc.), pliers, or any other weapon suitable for dispatching zombies.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. An electronic torch comprising:

at least one light emitting diode disposed in each one of a plurality of sections of the electronic torch, wherein each one of the plurality of sections of the electronic torch is independently selectable to activate the at least one light emitting diode disposed in each one of the plurality of sections of the electronic torch and further wherein the plurality of sections of the electronic torch includes four substantially 90 degree quadrants.

2. The electronic torch of claim 1, further comprising a five axis function switch.

3. The electronic torch of claim 2, wherein at least two axes of the five axis function switch allow scrolling through one or more electronic torch modes.

4. The electronic torch of claim 2, wherein at least two axes of the five axis function switch allow scrolling through one or more electronic torch brightness levels.

5. The electronic torch of claim 1, further comprising at least one of a top accessory fitting and a bottom accessory fitting.

6. The electronic torch of claim 1, further comprising one or more of a universal serial bus output disposed within the electronic torch, a power input jack disposed within the electronic torch, and a battery cutoff switch disposed within the electronic torch.

7. The electronic torch of claim 1, further comprising a plurality of lenses disposed around each one of the plurality of sections of the electronic torch.

8. The electronic torch of claim 1, further comprising a single lens disposed around the plurality of sections of the electronic torch.

9. The electronic torch of claim 1, wherein the electronic torch includes a charging output circuit.

* * * * *